United States Patent [19]

Goodley

[11] 3,963,191

[45] June 15, 1976

[54] STRAP DISPENSER FOR AUTOMATIC STRAPPING MACHINE

[75] Inventor: George F. Goodley, Media, Pa.

[73] Assignee: FMC Corporation, San Jose, Calif.

[22] Filed: Apr. 16, 1975

[21] Appl. No.: 569,324

[52] U.S. Cl. ..... 242/75.43; 242/54 R; 242/156.2

[51] Int. Cl.[2] ..... B65H 25/22; B65H 75/00

[58] Field of Search ..... 242/75.53, 75.43, 75.44, 242/67.1 R, 67.3 R, 67.2, 105, 156.2, 156, 54 R; 100/29

[56] References Cited

UNITED STATES PATENTS

| | | | |
|---|---|---|---|
| 2,905,406 | 9/1959 | Pedersen | 242/75.43 |
| 3,081,957 | 3/1963 | Van de Bilt | 242/54 R |
| 3,337,153 | 8/1967 | Hamlin | 242/75.43 |
| 3,602,452 | 8/1971 | Sauer | 242/75.43 |
| 3,688,999 | 9/1972 | Plattner | 242/75.43 |
| 3,717,313 | 2/1973 | Williams | 242/54 R |
| 3,759,169 | 9/1973 | Goodley | 100/29 |

*Primary Examiner*—Edward J. McCarthy
*Attorney, Agent, or Firm*—C. E. Tripp

[57] ABSTRACT

A strap dispenser for a strapping machine includes a dancer arm connected to a double acting pneumatic cylinder assembly wherein the piston has a rod end and a larger area piston end. Air under the same pressure is applied to both ends before strap feeding begins and during the time that the strapping machine is reversed to withdraw strap from the machine. The resultant differential pressure retracts the dancer arm with the assistance of a relatively weak spring. During strap feeding both ends of the cylinder are exhausted, the piston end exhausting through an adjustable throttle valve. This provides a passive resistance to advance of the dancer arm as the strap reel is being accelerated during the strap feeding operation.

6 Claims, 8 Drawing Figures

D-1
BRAKE ON
C-1
D
R
S
L
M
P
10
11
12
14
15
16
18
20
22
24
26
28
30
32
32a
34
36
37
40
41
42
46
48
52
53
74
78
84
86
90
94
96
98
100
102
104
104a
104b
106
110
112
116
118
120
122
124
A
B
C
ON-OFF VAVLE
FV

D
R
S
78
A
74
94
92
90
88
84
C
86
B
120
118
BRAKE ON
116
124
112
122
100
102
102a
98
96
110
104c
104b
104a
106
22
M
IDLE
140
135
134
SV-1, SV-2, V-3, V-5, S-V
138
137
V-4
AS
CL
141
L
L-3
SV-5
L-2
V-2
V-1
142
144
L-1
FV
PE-1
SOL.
V-6
SOL. V-6
ENERGIZED
pe-1
ON-OFF
P
14
18
16
24

D
R
S
BRAKE OFF
B
120
118
92
94
90
84
C
A
78
124
74
98
88
96
86
116
112
122
100
102
102a
110
104c
104b
104a
106
22
FEED
140
135
134
SV-1, SV-2, V-3, V-5, S-V
138
131
V-4
AS
141
L
CL
L-3
SV-5
L-2
V-2
142
144
V-1
L-1
PE-1
FV
ON-OFF DEPRESSED
SOL. V-6
SOL. V-6
pe-1
DEENERGIZED
M
P
14
18
16
24

D
R
S
BRAKE OFF
B
120
118
124
116
122
112
100
A
102
102a
110
104c
104b
104a
106
74
78
90
92
94
84
C
86
98
88
96
22
FEED CONTINUED
135
140
134
SV-1, SV-2, V-3, V-5, S-V
138
137
V-4
AS
CL
L
L-3
SV-5
L-2
V-2
141
142
144
V-1
PE-1
L-1
FV
ON-OFF
SOL.
V-6
SOL. V-6
pe-1
DEENERGIZED
M
P
14
18
16
24

D
R
S
BRAKE ON
B
120
118
124
116
122
112
100
102
102a
110
104c
104b
104a
106
74
90
94
92
84
A
C
98
88
96
86
78
W
L
134
SV-1, SV-2, V-3, V-5, S-V
140
REVERSE
22
M
135
CLOSES
138
AS
141
137
V-4
CL
L-3
SV-5
L-2
V-2
142
144
SHIFTS
V-1
L-1
PE-1
SOL. V-6
DEENERGIZED
pe-1
FV
OPENED
ON-OFF
P
14
18
16
STRAP TAKE UP
S-1
24

STRAP DISPENSER FOR AUTOMATIC STRAPPING MACHINE

FIELD OF THE INVENTION

This invention relates to apparatus for dispensing tension material from a reel and more particularly to apparatus for dispensing plastic strap or the like from a reel to an automatic strapping machine that first feeds the strap from the reel and around an article and then reverses to tension the strap about the article.

DESCRIPTION OF PRIOR ART

A known strap dispenser for strapping machines includes a dancer arm that is urged by a strong spring to its retracted position at which position it applies a brake to the dispensing reel. Since the spring loading on the dancer arm is substantial, this design momentarily applies a relatively high tension to the length of strap disposed between the dispenser and the strapping machine, as the supply coil or reel is initially accelerated by start up of the strap feed mechanism in the strapping machine. This initial high tension during acceleration of the reel will lead to splitting and abrasion of the strapping which in turn increases the frictional resistance of the strapping to its being fed through the yoke in the strapping machine. Such resistance of the strapping to feed in the strapping machine yoke can lead to a jam up and malfunction of the strapping machine.

Another problem arises in a strapping dispenser wherein the energy stored in the retracting spring of a spring loaded dancer arm is intended to supply the torque reaction required for initial acceleration of the strap reel. This problem arises after the reel has been accelerated until its speed of rotation matches the rate of strap feed by the strapping machine. When this condition is reached during a feeding cycle, a spring loaded dancer arm will swing back towards its fully retracted position. In dispensers wherein the dancer arm applies a reel brake in or near its fully retracted position, the effect of the brake must be overcome by an increased tension in the strap applied by the strapping machine feed mechanism, which tension will again advance the dancer arm. The brake is now released in these types of dispensers, but in addition to causing variations of strap tension during feed, the condition repeats itself and the resultant hesitant type of feeding operation, characteristic of the aforesaid prior known dispensers, can also result in a malfunction of the strapping machine.

SUMMARY OF THE INVENTION

The strap dispenser of the present invention is not subject to the disadvantages outlined above because it incorporates two basic principles as follows:

1. The energy stored in a dancer arm retracting spring is not relied upon to provide the strap tension necessary for initial acceleration of the reel. The dispenser of the present invention provides the dancer arm with what may be termed a "passive" resistance to advance of the arm during strap feeding and reel acceleration. This "passive" resistance to advance of the dancer arm is provided by connecting a double acting pneumatic cylinder to the dancer arm in a manner wherein air under pressure can be applied to both the rod end and to the piston end of the cylinder. Under these conditions the cylinder mounting and air connections are such that the effective area at the piston end of the cylinder is greater than that at the rod end, and when equal pressures are applied to both ends, the dancer arm is pneumatically retracted. An adjustable throttle valve is provided at the piston end of the cylinder to bleed air from that end of the cylinder. When the strap is being fed around the package by the strapping machine, the pull of the strap tends to advance the dancer arm, but now the air connections leading to the ends of the cylinder are opened to exhaust. Advance of the dancer arm is resisted by the air trapped in the piston end of the pneumatic cylinder. However, since air is bled from the piston end of the cylinder through the aforesaid adjustable throttle valve, the dancer arm is permitted to slowly advance under the pull of the tape thereby providing a passive but steady force or strap tension during the initial acceleration of the strap reel. Of course, the compressability or resilience of the air trapped in the piston end of the cylinder also facilitates smooth acceleration of the reel.

The aforesaid construction has another advantage in that when strap feed is steady, that is, after the period of reel acceleration has ended, the means for accommodating that acceleration, namely the air trapped in the piston end of the pneumatic cylinder, does not provide a force that urges the dancer arm strongly towards its retracted position, as would be the case if a spring provided the sole retracting force on the dancer arm. Thus, when the strap feed has been completed or when machine and reel speeds are equal, the arm throttle is adjusted so that the dancer arm will usually be substantially or almost completely advanced by the pull of the tape thereon. After completion of strap feed, the dancer arm will now be in an advanced position, and when air pressure is again applied to both ends of the pneumatic piston and cylinder assembly to retract the arm to its initial or start position the arm will have a full range of travel in its retract direction and hence can accommodate any loose strap loops at the supply coil due to coasting of the reel after the brake had been applied. Since substantially the full swing of the dancer arm retraction is available to take up slack, there is no slack in the length or loop of tape between the dispenser reel and the strapping machine reservoir that could pick up dirt or oil from contact with the floor or that could become entangled with other equipment or components in the area.

2. Under the present invention a reel brake is provided, but its action is independent of the dancer arm position. In the apparatus of the present invention and in its preferred embodiment, the reel brake is applied by a pneumatic cylinder and is spring released. The actuation of the brake cylinder is completely independent of the dancer arm position because the air under pressure for applying the brake is received from valves of the control circuit of the strapping machine itself. The brake is spring urged to its "off" position and is pneumatically actuated to its "on" position. Air under pressure for fully applying the brake is received from the strapping machine control circuit after the strapping machine has completed its feeding operation after which the strapping machine feed mechanism is reversed, first to take up a loop of strap that developed during feeding and then to tension the strap about a package. When the strap feed mechanism is reversed, the control system for the strapping machine also feeds air to both ends of the pneumatic dancer arm cylinder, which due to the differential area conditions just described, causes the cylinder to retract the dancer arm so as to tend to withdraw strap from the machine. Since the brake is now fully applied, such retraction of the dancer arm can withdraw the strap and does not merely unwind strap from the reel itself.

Several minor features of the apparatus of the present invention will be mentioned briefly. Although the resistance of the dancer arm to advance during feeding of the tape by the strapping machine is principally a passive pneumatic resistance controlled by the throttle valve previously described, it has been found preferable to include a relatively light spring in the dancer arm assembly which will assist the relatively small differential pressure effect in retracting the arm and which will retract the dancer arm to its starting position when the machine is shut down with no air to the dancer cylinder. However, this spring is by no means strong enough to supply the resistance to dancer arm advance necessary to accelerate the reel during feeding of the tape, and although it can take up slack in the strap it is not strong enough to restore the dancer arm to its initial or retracted position while tape is being fed under uniform velocity conditions of the reel and the machine feed mechanism.

As to the brake, it has been found preferable to adjust the brake so that it exerts a slight friction drag even in its "off" position during feeding of the tape by the strapping machine from the strap reel. This slight steady resistance of the brake to tape feeding prevents minor accumulations of slack in the reach of tape between the dispenser and the strapping machine, and maintains the dancer arm in its fully extended position during the aforementioned constant velocity condition.

The circuit to the double ended pneumatic damping cylinder which supplies air to both ends of that cylinder includes not only an adjustable throttle valve, described previously, but a check valve which is connected in parallell to the throttle valve. The check valve is so oriented that it opens when air under pressure is being supplied to the pneumatic cylinder, thereby freely directing air to the piston end of the cylinder. The check valve closes when air is being exhausted from the piston end of the cylinder during strap feed, thereby forcing all air from the piston end through the throttle valve to provide precise control of the dancer arm during reel acceleration.

DETAILED DESCRIPTION

Figures 1, 8:
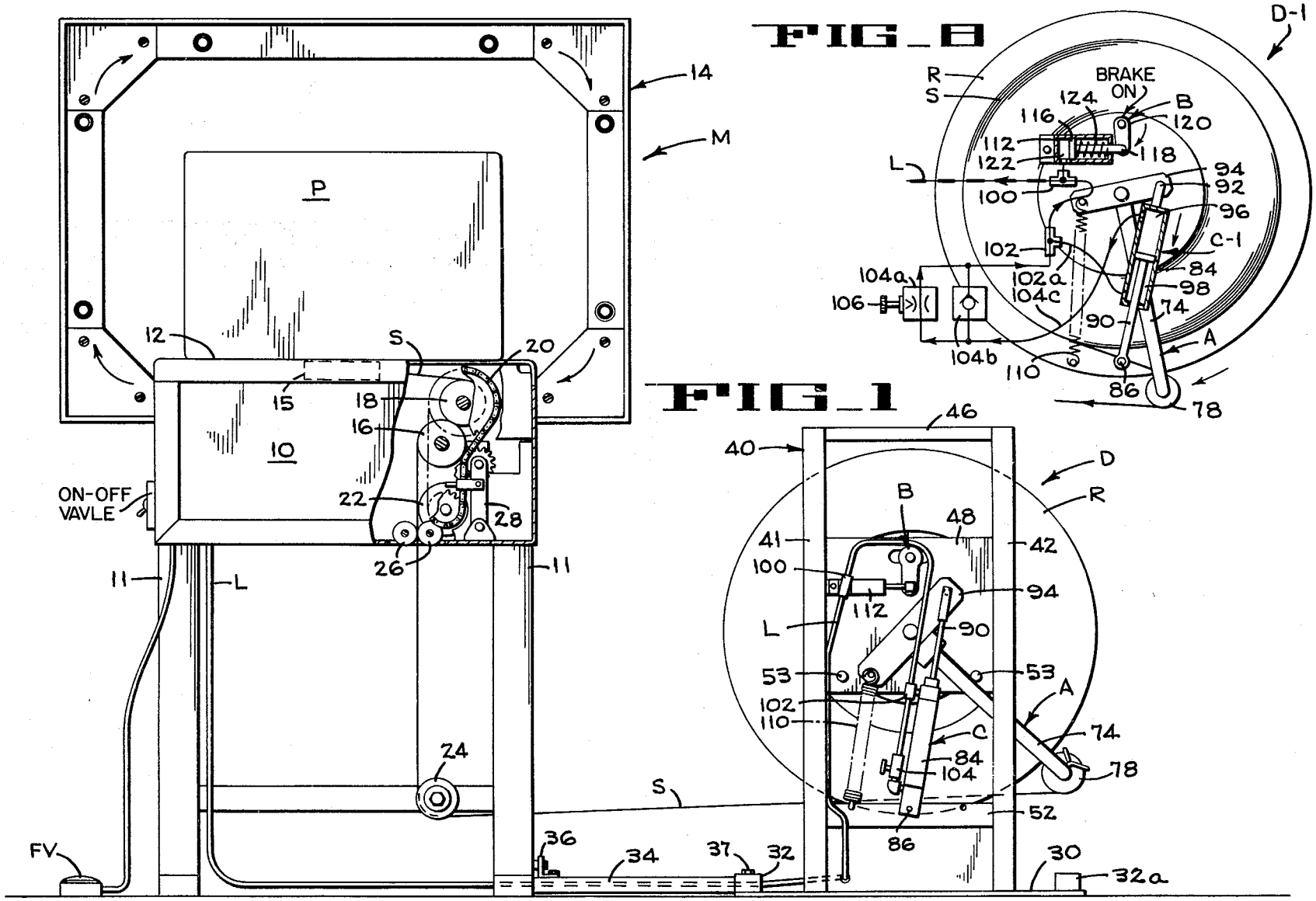
FIG. 1 is a side elevation showing a strap dispenser of the present invention associated with a package strapping machine.
FIG. 8 is a diagram of a dispenser showing a reversed mounting of the cylinder for the dancer arm.

In order to illustrate a typical utilization of the strap dispenser of the present invention, FIG. 1 shows a strap dispenser D of the invention associated with a strapping machine M. Although the strap dispenser can be utilized with other strapping machines, for clarity of illustration it is shown connected to a strapping machine such as that of the United States Goodley U.S. Pat. No. 3,759,169, issued Sept. 18, 1973 and assigned to the FMC Corporation. The disclosure of this Goodley patent is incorporated here by reference and only enough of the mechanism of the strapping machine of the aforesaid patent will be described to provide a complete understanding of the operation and principles of the dispenser D of the present invention.

Referring to the strapping machine M in FIG. 1, the machine includes a housing 10 which is broken away to indicate the strap feeding and tensioning mechanism and which is supported by legs 11. The housing has a table top 12 which supports a package P to be strapped and a yoke 14 surrounds the package. At the dotted area 15 are front and rear grippers for the strap as well as strap sealing and cutting mechanisms. The strap feeding and tensioning mechanism includes a feed wheel 16 that is geared to a tensioning wheel 18. The strap passes partially around these wheels and is gripped between them. The tensioning wheel 18 is driven by a chain 20 from a reversible motor 22 so that operation of the motor 22 in one direction feeds the strap and reversal of the motor withdraws the strap either to take up a loop of strap developed after feeding or to tension the strap around the package P. The length of strap received from the dispenser D passes around a lower pulley 24, between two guide pulleys 26 and into the feeding mechanism.

During feeding, the free end of the strap is fed beneath the package 12 and up around the yoke 14 in the direction of the arrows on the yoke. When the end of the strap reaches its final position it strikes a stop at a tongue, anvil and sealing blade construction in the dotted area 15, which are shown in the aforesaid patent. When the strap end is fed against the stop (not shown) a loop of strap is developed which stops strap feeding and reverses the motor 22 to withdraw the loop. The next step is the actuation of an air valve that again actuates the motor 22 in reverse, to pull the strap clear of the yoke 14 down onto the package P and tension the strap around the package. During strap tensioning, the free end of the strap will have been held by a front gripper and when the strap tension is completed, the bight of the strap is held by a rear gripper, in the dotted area 15. The superimposed portions of the tensioned strap beneath the package are now sealed and the strap is cut off by mechanism (not shown), in the area 15, completing the strapping operation. As explained in the aforesaid Goodley patent, the idler device 28 appearing in FIG. 1 is provided to stop the reverse actuation of the motor 22 during strap tensioning when a sufficient amount of tension has been imparted to the strap.

THE DISPENSER

The basic elements of a dispenser D embodying the invention, appear in the assembly view of FIG. 1. The dispenser includes a base 30 that rests on the floor and an upright or stand 40 for rotatingly supporting a reel R of strap S. Other fundamental features of the dispenser include a pivotally mounted dancer arm assembly A over which the strap passes en route from the reel R to the strapping machine M. The dancer arm is basically controlled by a double ended pneumatic cylinder assembly C and reel rotation can be braked by a pneumatically applied, spring released brake B, which is of the caliper type. An air line L leads from valving in the housing 10 of the strapping machine M and is connected to one end of the cylinder that applies brake B and to both ends of the dancer arm control cylinder assembly C.

Figure 3:
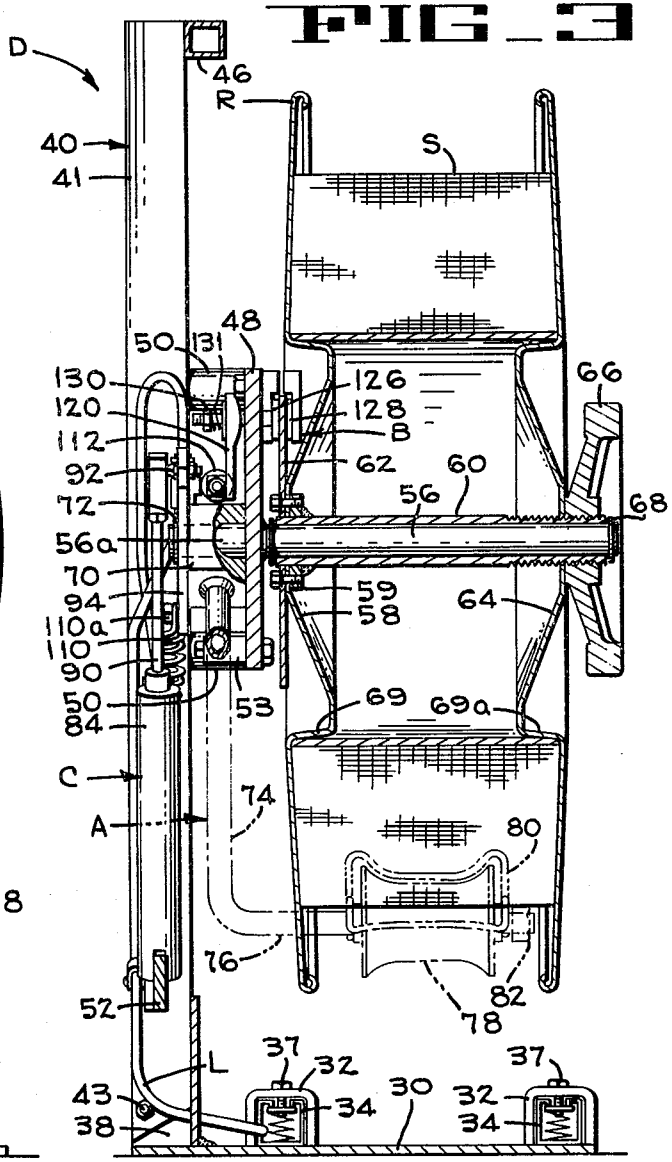
FIG. 3 is a section through the dispenser taken on line 3 — 3 of FIG. 2.
Figure 2:
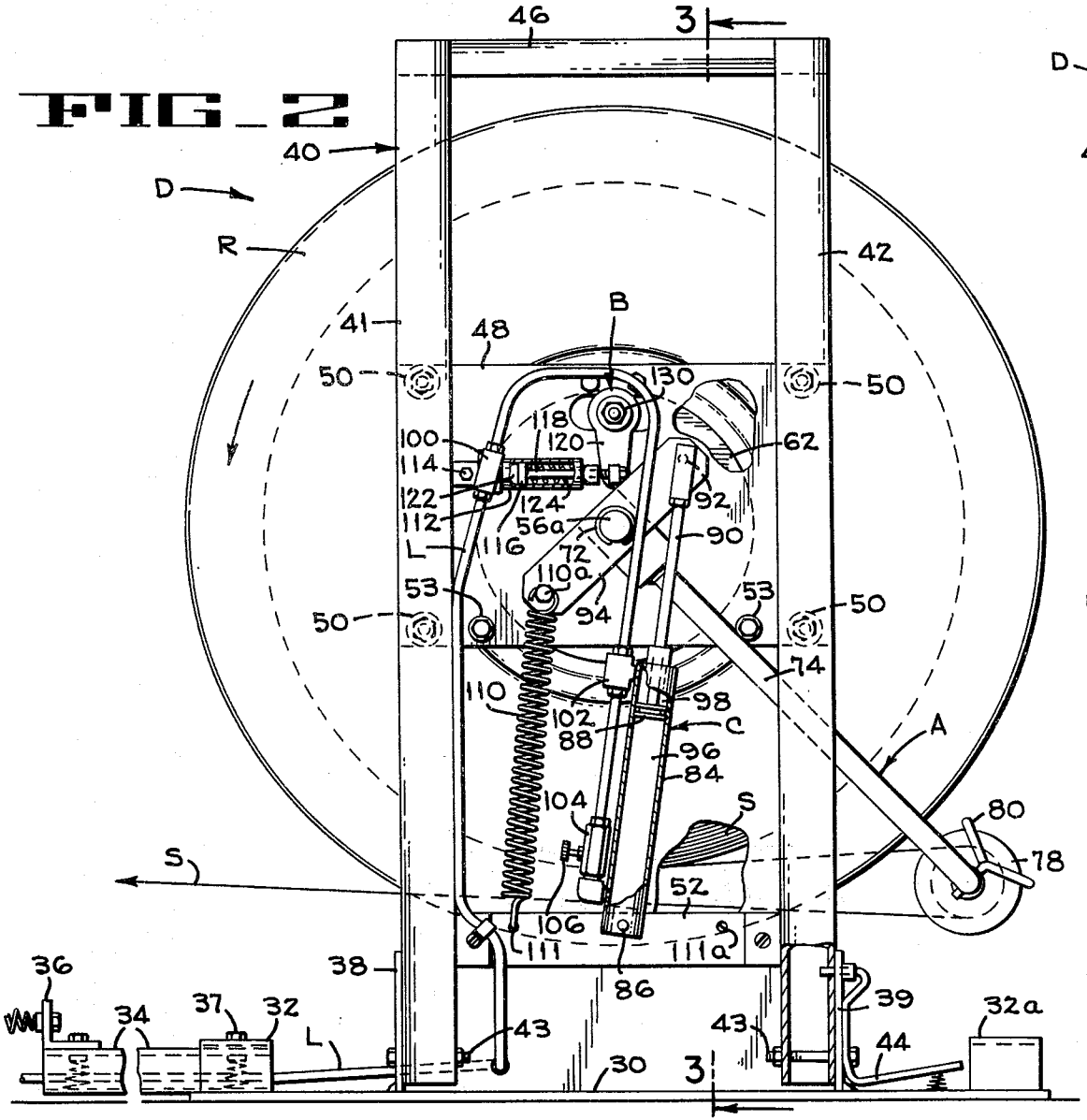
FIG. 2 is an enlarged side elevation of the dispenser.

Details of the construction of the dispenser D appear in FIGS. 2 and 3. The base 30 mounts a pair of U-shaped straps 32 which slidably receive spacer legs 34 that are bolted to the framework 11 of the strapping machine by means of angles 36. Clamp bolts 37 clamp the legs 34 to the strap 32. Straps 32a are provided at the other end of the base for mounting the dispenser from that end. Projecting upwardly from 38, 39 base 30 of the dispenser are hinge brackets 38,39 which pivotally mount the upright reel supporting stand 40. The stand is fabricated of structural elements including vertical legs 41, 42 which legs are pivoted to the brackets 38, 39 by pivot bolts 43. A latch 44 (FIG. 2) retains the stand 40 in its vertical, operating position but the latch can be released so that the stand can be hinged to a horizontal position to facilitate loading and unloading of a reel R on the stand.

In addition to the uprights 41, 42, the stand 40 includes an upper cross bar 46 and an intermediate mounting plate 48. The plate 48 is secured to bosses 50 which are attached to the uprights 41, 42. A lower cross bar 52 extends between the uprights of the stand. Rubber bumpers 53 on the plate 48 limit the motion of the dancer arm assembly A.

In order to rotatably support the reel R, a shaft 56 (FIG. 3) is welded to the mounting plate 48. The reel can be disassembled to receive a coil of strapping S. Thus, the reel is constructed to have an inner flange 58 that is bolted to a flange 59, which flange is welded to a hub sleeve 60 rotatable on the shaft 56. A brake disc 62 for the reel is also bolted to the hub flange 59. The outer reel flange 64 is removably secured to the sleeve 60 by a large nut 66 threaded on the sleeve. The reel sleeve 60 is retained on the shaft 56 by a snap ring 68.

When it is desired to change reels of strap S, the latch 44 (FIG. 2) is depressed and the stand 40 is pivoted to its horizontal position. The outer reel flange 64 is then removed and a new coil of strap is centered on a shoulder 69 on the inner reel flange. The outer reel flange 64, having a coil shoulder **69*a*, is then replaced and the stand 40** is returned to its upright position.

The dancer arm assembly A is swingingly mounted on an extension **56*a* of the shaft 56, which extension projects forwardly from the mounting plate 48. (FIG. 3). The dancer arm assembly includes a hub 70 that is freely rotatable on the shaft extension 56*a* and is retained thereon by a snap ring 72 (FIG. 2). Projecting from the dancer arm hub 70 is a dancer arm portion 74 which extends radially and is bent to extend axially, as best seen in broken lines in FIG. 3, thereby forming a shaft portion 76 that mounts a freely rotatable pulley 78 for receiving a loop of the strap S. The pulley 78 is retained on the shaft portion 76 of the dancer arm by a U-shaped guide wire 80 which is clamped in place by a nut 82 threaded to the shaft portion 76 seen in broken lines in FIG. 3.**

In normal operation, the dancer arm assembly A is controlled by the pneumatic cylinder assembly C. The cylinder assembly includes a cylinder proper 84 (FIG. 2), the lower end of which is formed as a clevis to pivotally mount the cylinder on the cross bar 52 by a pivot 86. The cylinder contains a double acting piston 88 connected to a piston rod 90, the free end of the rod being pivotally mounted at 92 (FIG. 2) to one end of a double ended crank arm 94 secured to the hub 70 of the dancer arm assembly. As seen in FIG. 2, the cylinder 84 has a piston end chamber 96 and a rod end chamber 98. Due to the presence of the piston rod 90, this provides a differential area device so that if equal pressures are applied to the chambers 96, 98, there will be a resulting force tending to expand the base end chamber 96 and move the piston 88 toward the upper end of the cylinder 84. This will retract the dancer arm.

The air connections to the cylinder assembly C are as follows: The line L which is connected to the control valve system in the strapping machine M runs to a tee 100 (FIG. 2). Although this tee is also connected to the brake B, air passes through the tee 100 and on to a second T 102 at the rod end of the cylinder 84. This tee provides an air connection to the rod end chamber 98, previously described. The line L continues from the second tee 102 to a combination fitting 104. As will be explained presently, the combination fitting 104 includes an adjustable throttle valve and a check valve connected in parallel. The throttling of the throttle valve can be controlled by adjustment of the needle valve screw 106. The lower end of the fitting 104 is connected to the piston chamber 96 of the cylinder.

A coil spring 110 is connected at 110a to one end of the crank 94 and at 111 to the cross bar 52. This spring lightly urges the dancer arm toward a retracted position.

The brake B is constructed so when there is air under pressure in the line L, the brake is applied and when the line L is open to exhaust a spring releases the brake. The brake assembly includes a pneumatic cylinder 112 (FIG. 2) which is pivotally mounted to the mounting plate 48 at 114. The cylinder piston 116 is connected to a piston rod 118 which rod is pivotally mounted to a brake operating arm 120. The brake cylinder 112 provides a pneumatic chamber 122 which when pressurized, applies the brake. When the brake chamber 122 is open to exhaust, a spring 124 surrounding the piston rod 118 moves the piston 116 to the left in the figure and releases the brake. The brake arm 120 forms part of a caliper type brake assembly which includes brake shoes 126, 128, FIG. 3, that can be cammed against the brake disc 62 on the reel. A brake arm 120 has a camming function that brings the brake shoes 126, 128 against the brake disc. An adjusting nut 130 is provided on the shaft for the brake arm 120 which nut can be adjusted to control the degree of brake application and is preferably adjusted so that even when the brake is released, the brake shoes exert a slight drag on the reel brake disc 62. This is accomplished by insertion of a spring 131 between the nut 130 and the arm 120. The details of the brake just described are not critical to the present invention. Any drag adjustable brake that can be operated by the pneumatic cylinder could be used to replace that herein illustrated. The specific brake illustrated is manufactured by the H-H Products Division of the Kelsey-Hayes Company of Mequon, Wisconsin. The particular model employed is a series 230M2 (floating mount) assembly which is one of the 200 series of mechanical caliper type disc brakes manufactured by the aforesaid H-H Products Division.

As mentioned, the cross bar 52 is drilled at 111 to receive one end of the spring 110. The bar 52 is also drilled at 111*a* so that the direction of tape emergence can be reversed 180° if desired. Under the latter conditions, the pivot 92 of the piston rod 90 would be connected to the crank 94 at the location of the spring anchor 110*a*. The spring 110 would then be connected between the crank 94 at the location of the piston rod pivot 92, shown in FIG. 2, and the auxiliary hole 111*a* in the cross bar 52. Under these conditions the legs 34 would be secured in brackets 32*a* at the right of the frame 30, as viewed in FIG. 2. Also the keeper 80 on the dancer arm is reversed.

CIRCUIT DIAGRAMS

The operation of the dispenser D in conjunction with the strapping machine M will be explained in connection with the pneumatic diagrams of FIGS. 4 – 7. As previously mentioned, in order to illustrate a typical utilization of the dispenser, it is shown connected to the air circuit of the strapping machine shown in the Goodley U.S. Pat. No. 3,759,169. Only certain of the control valve connections, valves and other elements of the control circuit for the strapping machine of that patent are illustrated in the aforesaid diagrams, and only those valves and elements will be described in detail which are essential to an understanding of how the dispenser cooperates with a strapping machine. The control element shown in FIGS. 4 – 7 can be keyed to the schematic diagrams beginning with FIG. 32 of the aforesaid Goodley patent.

Figure 4:
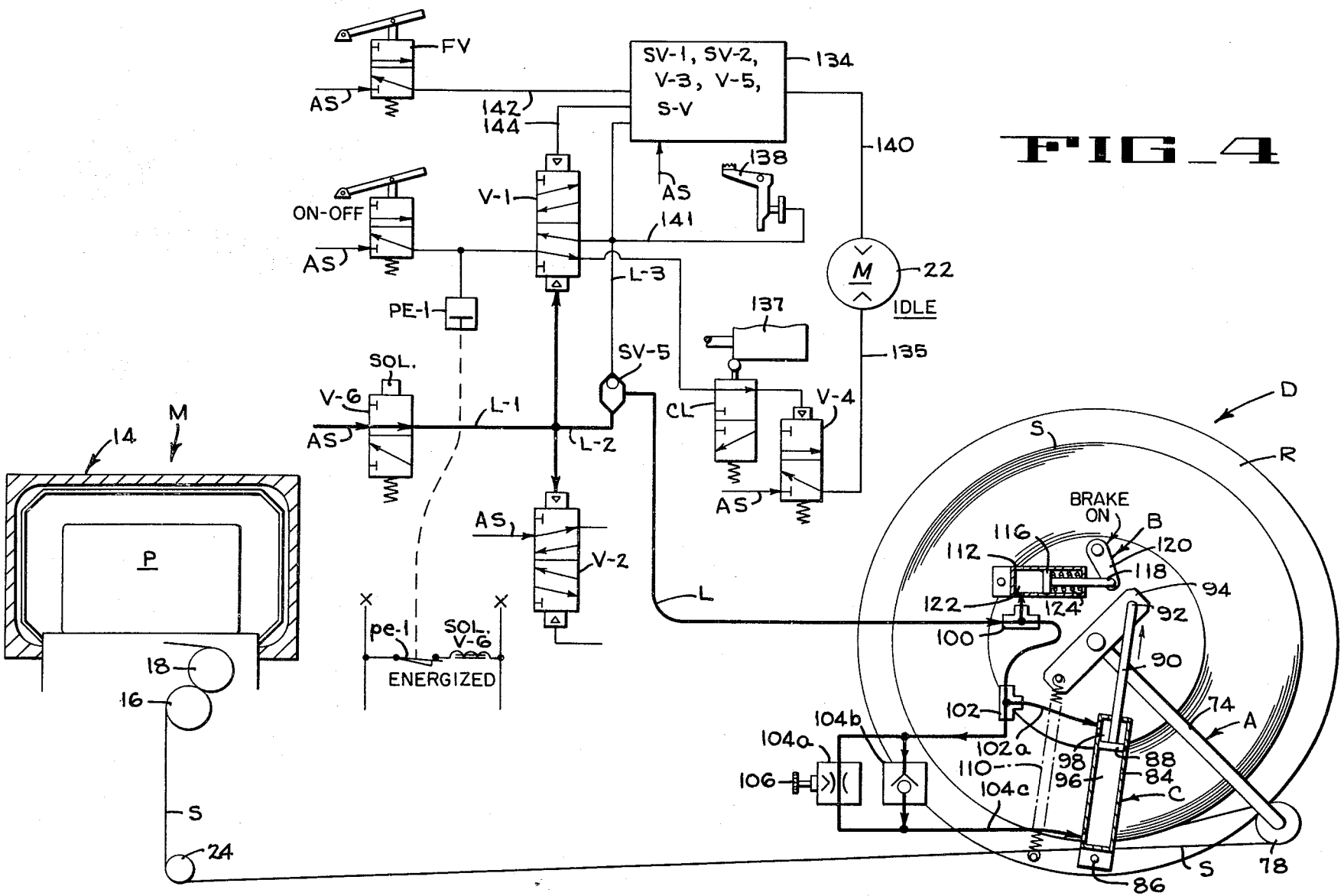
FIG. 4 is a schematic diagram showing the strap dispenser connected into the air system of an air controlled strapping machine.

FIG. 4 shows the dispenser in its starting condition ready to accommodate the feeding of strap by the strapping machine M, and dancer arm assembly A is fully retracted to its right hand position in the figure. The valves shown in FIG. 4, forming part of the strapping machine control circuit, includes a foot valve FV which is actuated by the operator to initiate strap tensioning after the strap has been fed around the package P. Also included is an On-Off valve which is actuated by the operator to set up the control circuit for operation. A solenoid operated valve V-6 is connected to an air supply AS (these air supply connections are repeated for other units in the diagram) and which is solenoid operated under control of a pressure operated switch PE-1 the diaphragm of which is mechanically connected to its contacts pe-1, the latter being wired across the line in series with the solenoid for the valve V-6 just mentioned. In the conditions of FIG. 4 there is no air pressure on the diaphragm of PE-1 and its contacts pe-1 are closed, thereby energizing the solenoid of valve V-6. This places the valve V-6 in the condition shown in FIG. 4 so that air from the air supply AS is passed on through the valve and into the circuit by means of a line L-1. Other valves and elements shown are a pair of air shifted spool valves V-1, V-2 and not illustrated in the diagram but present in the actual circuit, are various valves such as SV-1, SV-2, V-3, V-5 and S-V. These are all shown in a single box 134. In addition, a cam limit valve CL is shown which controls an air shifted, spring return valve V-4 that is connected by a line 135 to the reversible motor 22 (also see FIG. 1) that drives the feed and tensioning wheels 16 – 18 of the strapping machine. The cam limit valve CL controls the valve V-4 and is operated by a plurality of cams 137 all as described in the aforesaid Goodley patent and this sequence of operation is not material to understanding the present invention. Also shown, is a diaphragm operated front gripper 138 which is closed upon the free end of the strap after it has been fed around the yoke 14 (FIG. 1). An air line 140 leads from valve units in the box 134 to the motor 22 for driving the latter in the reverse direction.

A shuttle valve SV-5 has been added to the circuit shown in the aforesaid Goodley patent. The air line L for the dispenser runs from the side of this shuttle valve. One end of the shuttle valve is connected to a line L-2 which has been added to the patent circuit and forms a continuation of the line L-1 which is present in the circuit of the patent. Also, a line L-3 has been added to the patent circuit and this line connects the other end of the shuttle valve SV-5 to a line 141 connected to the diaphragm that operates the front gripper 138.

OPERATION

The condition of the circuit shown in FIG. 4 corresponds to that shown in FIG. 32 of the Goodley patent wherein the On-Off valve of the strapping machine has not been manually depressed, there is no pressure on the diaphragm of PE-1, contacts pe-1 are closed, and the solenoid valve V-6 is energized. The valve V-6 now conducts air from the air supply AS of V-6 through the line L-1 to one set of shifters for V-1 and V-2 and to the additional line L2 leading to the lower end of the shuttle valve SV-5. The shuttle valve thereby transmits the air under pressure to the line L leading to the brake and damper cylinders of the dispenser D of the present invention.

Shown diagramatically in the diagram of FIG. 4, are the two elements of the combination fitting unit 104, previously mentioned. These elements are an adjustable throttle valve 104*a* controlled by the needle valve adjustment 106 and a check valve 104*b* connected in parallel with the throttle valve.

When air under pressure is in the dispenser line L, as in the condition of FIG. 4, the air passes through the brake tee 100 into the brake chamber 122 and on to the damper cylinder tee 102. The T 102 directs air under pressure via a passage 102a to the rod chamber 98 of the cylinder 84. Air under pressure continues on through the tee 102 to the throttle and check valves 104*a*, 104*b*. The check valve 104*b* is arranged so that it is opened by the air under pressure under these conditions and hence the air is transmitted by a passage 104*c* to the piston chamber 96 of the cylinder 84. Although the cylinder chambers 96, 98 receive equal pressures, because of the differential area effect previously mentioned, chamber 96 expands and the piston 88 is urged upwardly to retract the dancer arm assembly A to the right, which readies the dancer arm pulley 78 for maximum take-up action. The aforesaid pneumatic retraction force is augmented by the spring 110.

As mentioned, air from the tee 100 is also directed to the chamber 122 of the brake B which moves the brake piston 116 to the right (as viewed in FIG. 4) thereby applying the brake and placing it in the "Brake On" condition. This brakes the reel R by means of the caliper and brake disc assembly, previously described.

Figure 5:
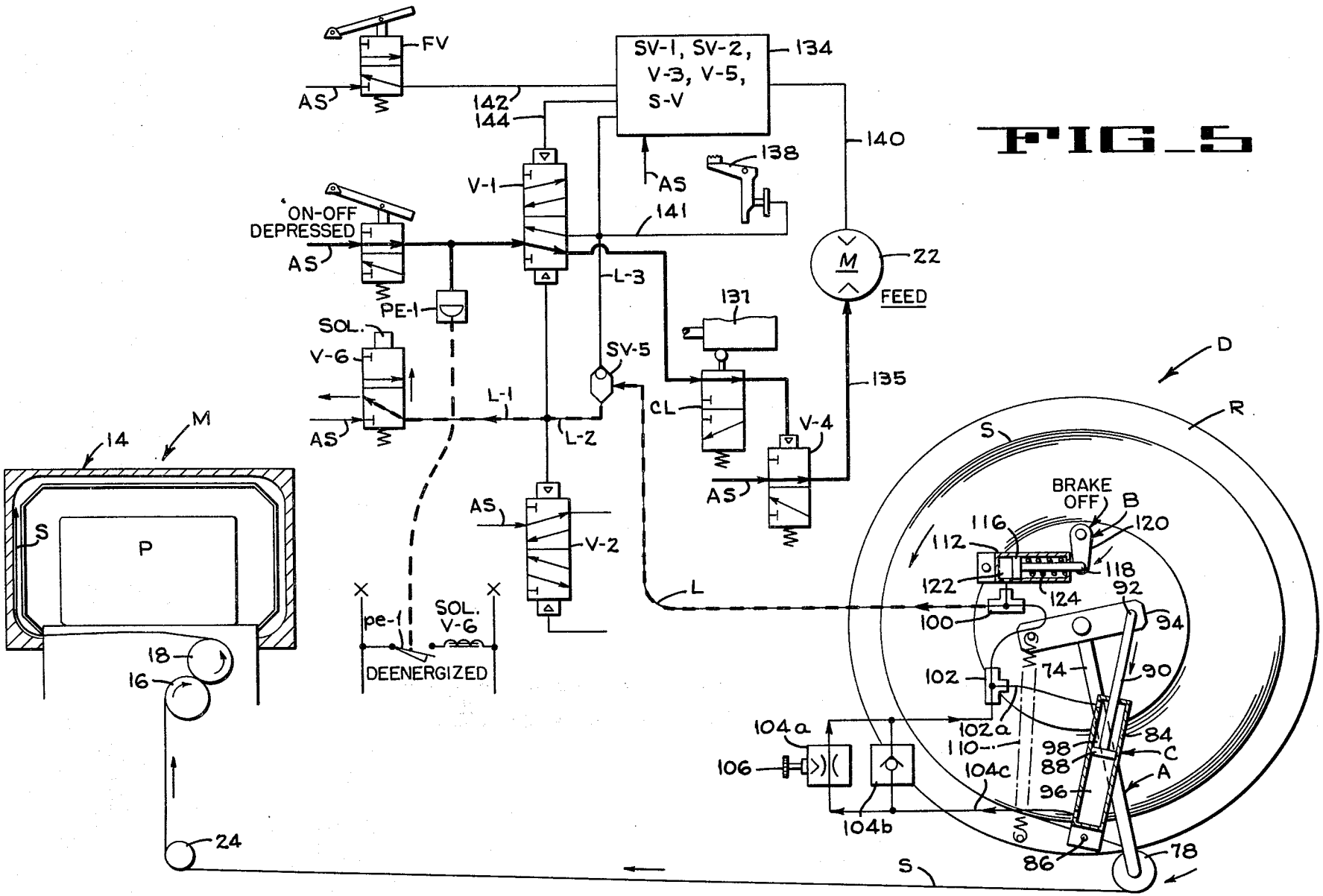
FIG. 5 is a diagram like that of FIG. 4 showing the action during initial feeding of the strap.

The diagram of FIG. 5 illustrates the conditions when strap is being fed by the transport wheels 16, 18 of the feed mechanism of the strapping machine and the strap reel R is being accelerated. To initiate strap feeding, the On-Off valve has been depressed so that air under pressure from the air supply AS is directed through the valves V-1 and CL to the pilot of valve V-4. This shifts the valve V-4 which now supplies air to the line 135, which is the "Feed" line leading to the motor 22 that drives the transport wheels 16, 18. Also, when the On-Off valve is depressed, the pressure switch assembly PE-1 also receives air under pressure and its contacts pe-1 are opened, deenergizing the solenoid of the valve V-6. This opens the lines L-1, L-2 and the dispenser air line L to exhaust.

At the dispenser, when the line L is connected to exhaust through the strapping machine air circuit, as just described, pressure is relieved in the brake cylinder chamber 122 and the spring 124 releases the brake and places it in the "Brake Off" position. However, as previously mentioned, the brake is preferably adjusted so that even in the "Brake Off" position, it exerts a slight drag on the brake disc 62, shown in FIG. 3.

With the dispenser air line L connected to exhaust, the rod end chamber 98 of the dancer arm cylinder 84 is likewise connected to exhaust through passage 102*a* and the tee 102. The piston end chamber 96 of the cylinder 84 is connected to exhaust through the passage 104*c* and through the adjustable throttle valve 104*a*. The flow of air in the exhaust direction in the passage 104*c* will close the check valve 104*b* so that all of the air being exhausted from the piston end chamber 96 of the cylinder must pass through the throttle valve 104*a*.

The resistance to acceleration of the strap reel R under action of the strap feeding mechanism 16, 18 results in the strap pulling or advancing the dancer arm A to the left, by means of its pulley 78. This advance of the dancer arm is passively resisted, because in order for such advance to take place, the piston 88 must move into the chamber 96 and air trapped in the chamber 96 can only be expelled from that chamber through the adjustable throttle valve 104*a*. Thus, by adjusting the screw 106 of the throttle valve 104*a*, a controlled, passive resistance to advance of the dancer arm A is provided. This resistance is sufficient to prevent immediate swinging of the dancer arm to its fully advanced position as soon as feed starts, which condition would eliminate the acceleration control function of the dancer arm. However, the resistance provided by the throttle valve 104*a* is not great enough to prevent a steady advance of the dancer arm assembly A to the left, as viewed in FIG. 5, resulting in smooth acceleration of the reel R and a reduction in the tendency of the feeding mechanism to abrade or break the strap S. The conditions of FIG. 5, wherein the strap is being fed around the yoke 14, correspond to those of FIG. 33 of the aforesaid patent.

Figure 6:
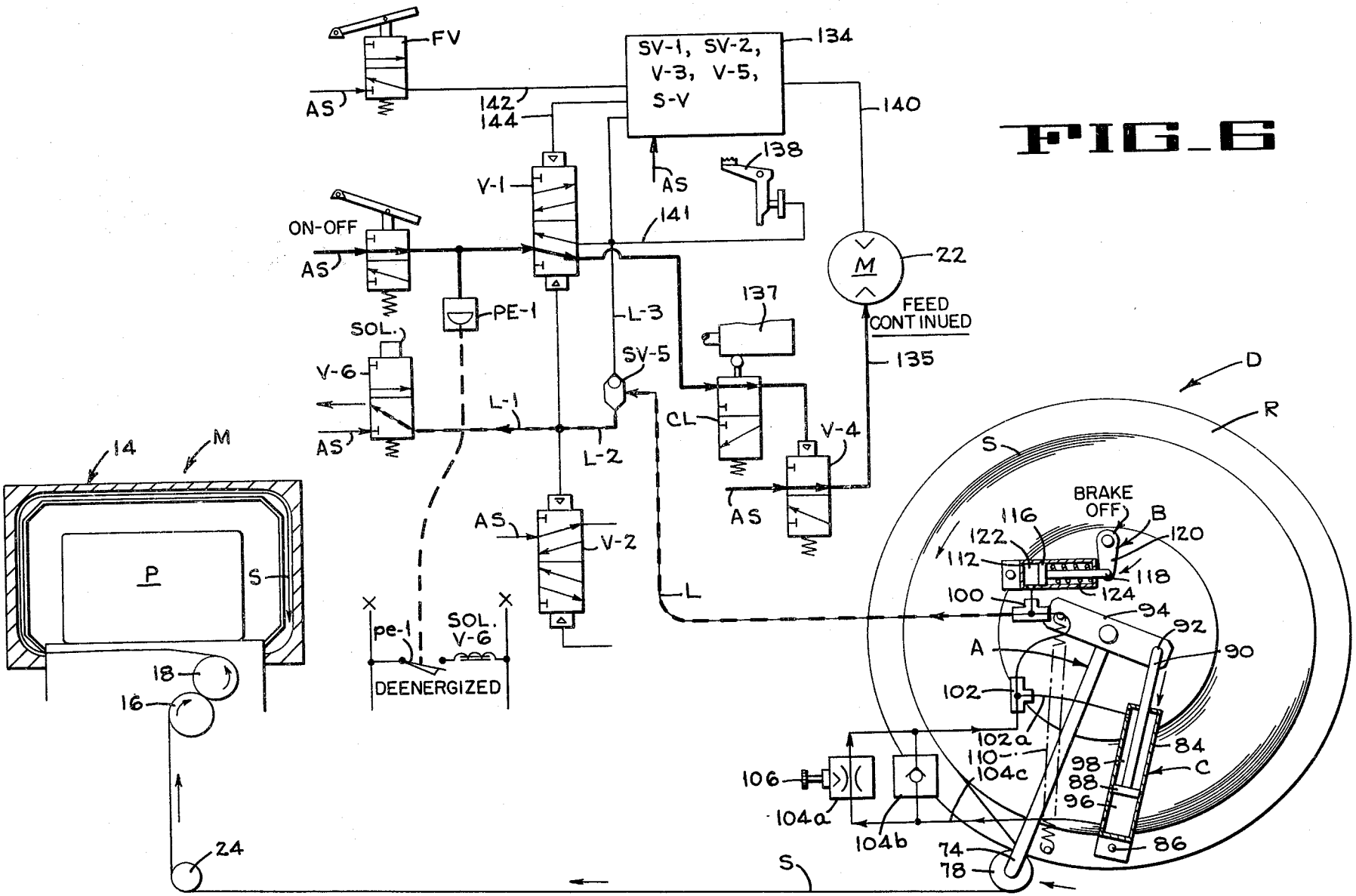
FIG. 6 is a diagram like that of FIG. 5 after strap feeding has continued for some time.

The diagram of FIG. 6 shows the same circuit conditions as those illustrated in FIG. 5. However, in FIG. 6 strap feeding has been substantially completed and the reel R will have been accelerated to its final velocity so that the feeding is under steady conditions. The dancer arm assembly A, having accommodated acceleration of the reel, has been pulled or advanced to the left in the figure and will remain in substantially that position during completion of the feeding operation. In both the operations illustrated in FIGS. 5 and 6 just discussed, the relatively weak spring 110 is urging the dancer arm assembly A to the right or towards its retracted position. However, the pull of the strap on the dancer arm pulley 78 prevents motion of the dancer arm to the right and under force of the spring 110, but as previously mentioned, the energy stored in the spring 110 is not enough to accelerate the reel R sufficiently to permit any substantial retraction of the dancer arm against the force of the strap S acting thereon. Also, and as previously mentioned, slight drag on the brake maintains sufficient tension in the strap between machine and dispenser to prevent arm retraction due to spring 110.

Figure 7:
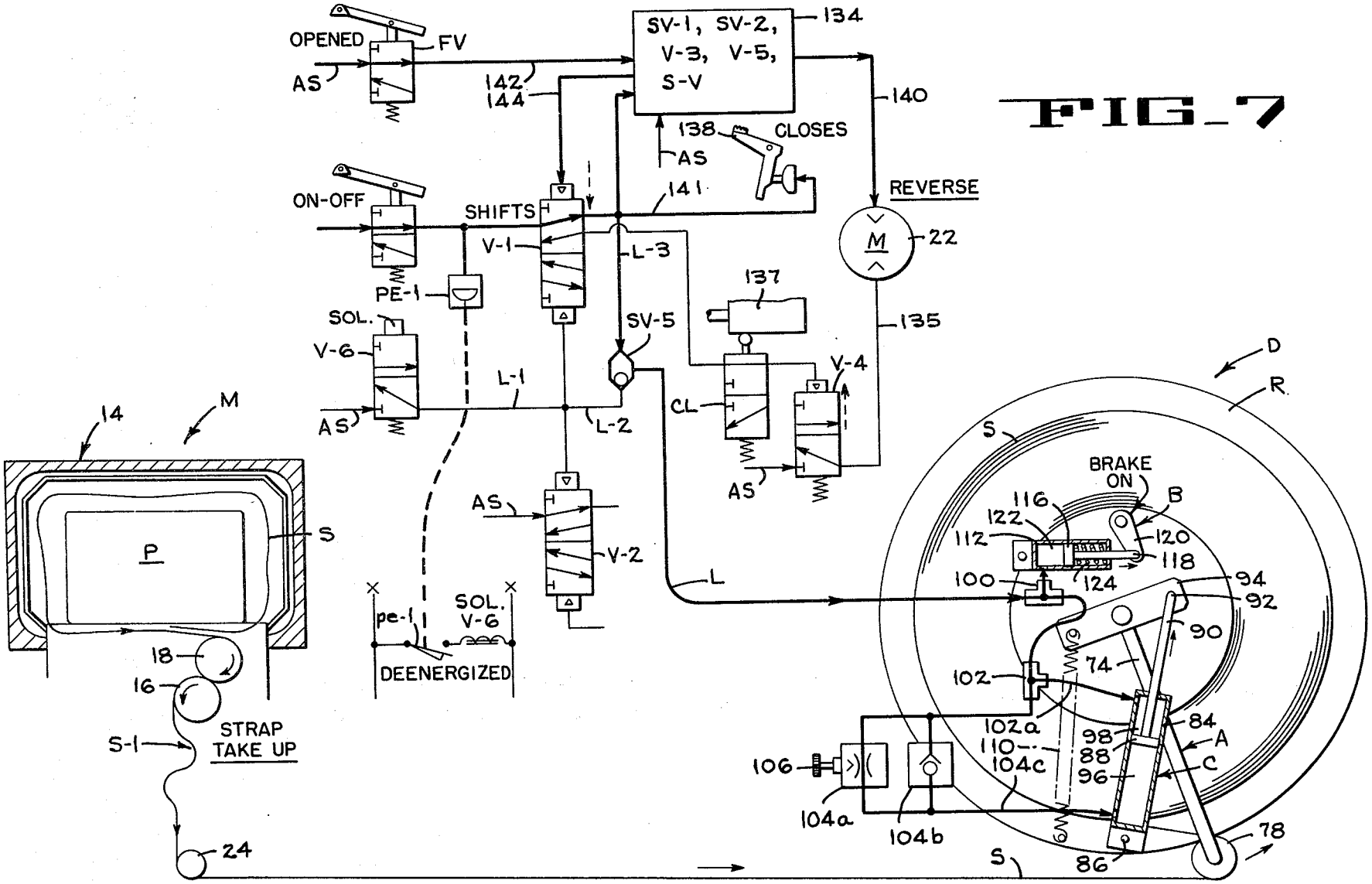
FIG. 7 is a diagram showing the action when the strap feeding mechanism reverses to take up strap for tensioning.

The diagram of FIG. 7 illustrates the control circuit conditions when the motor 22 is reversed to take up strap, either to take up a loop of strap developed at the end of the feeding or as illustrated in the diagram of FIG. 7, to take up strap S-1 fed into the strapping reservoir when the motor 22 is reversed in order to withdraw a strap from the yoke 14, and tension it about the package P. In the diagram of FIG. 7, the foot valve FV has been opened in order to initiate the tensioning operation, which corresponds to FIG. 36 of the Goodley patent. This conducts air under pressure from the air supply AS to a line 142 leading to a number of valves shown in the box 134 connected to that line. The result of this operation includes the direction of air by a line 144 to shift the valve V1 so that air from the air supply connected to the On-Off valve (which is open as before) is now conducted to line 141 to close the front gripper 138 and to grip the free end of the strap that has been fed around the yoke. Air is also conducted from the valve group 134 to the line 140, to reverse the motor 22 that drives the transport wheels 16, 18 for taking up strap. Also in the circuit conditions of FIG. 7, air under pressure is now conducted from the valve V-1 to the line L-3, which has been added to the basic circuit shown in FIGS. 34 and 36 of the Goodley patent. Air in the line L-3 shifts the shuttle valve SV-5 which directs air under pressure from L-3 to the line L leading to the dispenser D of the present invention.

When the dispenser line L is pressurized, the brake cylinder chamber 122 is also pressurized, as described in connection with FIG. 4, which applies the brake and prevents further rotation of the reel R. Air under pressure from line L is likewise directed to the rod end chamber 98 of the dancer arm cylinder by the tee passage 102*a*. Air under the same pressure passes through the tee 102, opens the check valve 104*b* to the passage 104*c* and enters the piston end 96 of the dancer arm cylinder 84. Since both the rod and piston ends of the cylinder 84 now receive air under the same pressure, the differential area effect on the piston 88 will urge the dancer arm assembly A to the right in the figure, to take up any loose loops of strap that may result from coasting of the reel assembly after the brake is applied.

The pneumatic retraction action on the dancer arm assembly just described, which takes up loose strap developed at the reel supply of the dispenser, is augmented by the action of the spring 110 which also urges the dancer arm to the right. Thus, it can be seen that by providing the differential area pneumatic cylinder construction just described for control of the dancer arm, a passive resistance to advance of the dancer arm under tension of the strap being pulled therethrough during strap feeding is provided and although a dancer arm retraction spring is provided, this spring is relatively weak and does not store enough energy to cause acceleration of the reel during strap feeding. Thus the spring will not cause the dancer arm to creep back towards its fully retracted position after the reel has been accelerated and strap feeding is continued under equilibrium conditions. Also, brake engagement is independent of dancer arm position and the brake is applied only when needed. The brake is not cyclically applied and released during the strap feeding operation, which would provide a non-uniform dispensing operation.

MODIFICATION

FIG. 8 shows a modified dispenser D-1, wherein the dancer arm cylinder C-1 has been mechanically reversed end-to-end so that the piston rod 90 is pivoted to the crossbar at the pivot 86 which formerly received the clevis for the cylinder 84. The cylinder 84 is pivoted to the crank arm 94 of the dancer arm at the location 92 which formerly received the pivot for the piston rod 90. Because of this reversal of the cylinder C-1 from the previous arrangement the lines 102*a* and 104*c* are shown crossed in the air circuit diagram. However, their respective connections to the rod end chamber 98 and to the piston end chamber 96 of the cylinder C-1 are the same as before. The mode of operation of this modification will be like that described in conjunction with the diagrams of FIGS. 4 – 7.

Although the best mode contemplated for carrying out the present invention has been herein shown and described, it will be apparent that modification and variation may be made without departing from what is regarded to be the subject matter of the invention.

I claim:

1. A strap dispenser for a strapping machine which machine has a strap feed mechanism for feeding strap around an article and for thereafter tensioning the strap around the article, said dispenser being of the type comprising a frame, a strap reel, a dancer arm pivoted on the frame for guiding strap from said reel to the strap feed and tensioning mechanism and a brake for the reel; the improvement comprising a pneumatic piston and cylinder assembly connected between said dispenser frame and said dancer arm for retracting said dancer arm when air under pressure is applied to said assembly, air line means for supplying air under pressure to said piston and cylinder assembly before said strapping machine feed mechanism starts feeding strap, means for connecting said air line means to exhaust when said strapping machine starts feeding strap and pulls strap from the reel while advancing said dancer arm, a throttle valve for bleeding said piston and cylinder assembly to exhaust while said dancer arm is being advanced, and control means for applying said reel brake when air under pressure is directed to said piston and cylinder assembly, said brake control means being independent of dancer arm position.

2. A strap dispenser for a strapping machine which machine has a strap feed mechanism for feeding strap around an article and for thereafter tensioning the strap around the article, said dispenser being of the type comprising a frame, a strap reel, a dancer arm pivoted on the frame for guiding strap from said reel to the strap feed and tensioning mechanism and a brake for the reel; the improvement comprising a double acting pneumatic piston, piston rod and cylinder assembly connected between said dispenser frame and said dancer arm for retracting said dancer arm, said piston rod extending through one end only of said cylinder, air line means for simultaneously supplying air under pressure to both ends of said piston and cylinder assembly for retracting the dancer arm before said strapping machine feed mechanism starts feeding strap, means for connecting said air line means to exhaust when said strapping machine starts feeding strap and pulls strap from the reel while advancing said dancer arm, a throttle valve for bleeding the piston end of said piston and cylinder assembly to exhaust while said dancer arm is being advanced, and control means for applying said reel brake when air under pressure is directed to said piston and cylinder assembly, said brake control means being independent of dancer arm position.

3. The dispenser of claim 2, comprising a check valve in said air pressure supply, said check valve closing while said dancer arm is being advanced to direct air through said throttle valve.

4. A strap dispenser for a strapping machine which machine has a reversible motor driving a strap feed mechanism in one direction for feeding strap around an article and in the reverse direction for thereafter tensioning the strap around the article, a pneumatic control valve system for said motor, said dispenser being of the type comprising a frame, a strap reel, a dancer arm pivoted on the frame for guiding strap from said reel to the strap feed and tensioning mechanism and a brake for the reel; the improvement comprising a pneumatic piston and cylinder assembly connected between said dispenser frame and said dancer arm, valve means in said motor control system for supplying air under pressure to said piston and cylinder assembly for extending the assembly and retracting said dancer arm, said valve means supplying air to said assembly before said motor starts running in its strap feeding direction and when said motor is reversed for tensioning the strap, said valve means shutting off said air supply to the piston and cylinder assembly when said motor starts running in its strap feeding direction to pull strap from the reel while advancing said dancer arm, a throttle valve for bleeding said piston and cylinder assembly to exhaust while said dancer arm is being advanced, said throttle valve resisting advance of the dancer arm, and a pneumatic actuator for said reel brake, said valve means causing said brake actuator to apply the brake when air under pressure is directed to said piston and cylinder assembly.

5. The dispenser of claim 4, wherein said piston and cylinder assembly is double acting and provides a piston end chamber and a piston rod end chamber in the cylinder, said valve means supplying air to both chambers, said throttle valve bleeding only the piston end chamber as the latter is collapsed during advance of the dancer arm.

6. The dispenser of claim 5, comprising a check valve connected in parallel with said throttle valve, said check valve closing when the piston end of said chamber is being bled through said throttle valve.

* * * * *

UNITED STATES PATENT OFFICE

CERTIFICATE OF CORRECTION

PATENT NO. : 3,963,191

DATED : June 15, 1976

INVENTOR(S) :

It is certified that error appears in the above-identified patent and that said Letters Patent are hereby corrected as shown below:

Col. 5, line 19, after "from" delete "38,39" and insert -- the --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*